US005709097A

United States Patent [19]

Kim et al.

[11] Patent Number: 5,709,097

[45] Date of Patent: Jan. 20, 1998

[54] MULTIROOM AIRCONDITIONER

[75] Inventors: Tae-Geun Kim, Seoul; Kew-Wan Kim; Jeong-Seok Kim, both of Kyunggi-do, all of Rep. of Korea

[73] Assignee: Mando Machinery Corp., Rep. of Korea

[21] Appl. No.: 773,867

[22] Filed: Dec. 27, 1996

[30] Foreign Application Priority Data

Dec. 27, 1995 [KR] Rep. of Korea ..... 95-59624
Dec. 27, 1995 [KR] Rep. of Korea ..... 95-59627

[51] Int. Cl.[6] ..... F25B 41/00

[52] U.S. Cl. ..... 62/206; 62/200; 62/511; 62/175

[58] Field of Search ..... 62/205, 204, 206, 62/511, 199, 200, 217, 175, 525, 527, 528

[56] References Cited

U.S. PATENT DOCUMENTS

| | | | |
|---|---|---|---|
| 4,389,855 | 6/1983 | Ueda et al. | 62/217 X |
| 4,644,756 | 2/1987 | Sugimoto et al. | 62/200 X |
| 4,766,735 | 8/1988 | Gotou | 62/175 |
| 5,263,333 | 11/1993 | Kubo et al. | 62/206 X |

*Primary Examiner*—Harry B. Tanner
*Attorney, Agent, or Firm*—Anderson Kill & Olick, P.C.

[57] ABSTRACT

A multiroom airconditioner includes a plurality of indoor units, each of them having an indoor heat exchanger, an outdoor unit having an outdoor heat exchanger and a device for equalizing the pressure of the refrigerant flowing from the indoor units to the outdoor unit, wherein the outdoor heat exchanger is divided into an identical number of sections as that of the indoor heat exchanger, each of the sections being connected to each of the indoor units in one to one basis.

9 Claims, 3 Drawing Sheets

MULTIROOM AIRCONDITIONER

FIELD OF THE INVENTION

The present invention relates to a multiroom airconditioner including an outdoor unit and a plurality of indoor units; and more particularly, to the outdoor unit having a condenser, wherein the condenser is divided into a same number of sections as that of the indoor units, each of the sections being connected to each of the indoor units.

BACKGROUND OF THE INVENTION

There is shown in FIG. 1 a conventional multiroom airconditioner. The multiroom airconditioner includes a compressor 1, an outdoor unit 2, a plurality of indoor units 3 and refrigerant conveying conduits 4 for connecting the outdoor unit 2 with the indoor units 3.

In the cooling operation of the conventional multiroom airconditioner, the high temperature and high pressure refrigerant discharged from the compressor 1 passes through the refrigerant conveying conduits 4 and the outdoor unit 2 to each of the indoor units 3, which, in turn, acts to exchange the heat of the refrigerant with that of the indoor air.

In such an arrangement, when any one of the indoor units stops operating for one reason or another, the capacity of the outdoor unit may become more than enough for operating the indoor units. Although such a problem may be partially solved by controlling the number of rotation of the motor in the compressor, this produces other problems in the outdoor unit, e.g., a liquid back up.

SUMMARY OF THE INVENTION

It is, therefore, an object of the present invention to provide a multiroom airconditioner which is structurally simple and easy, and hence, easy to manufacture, and at the same time, which allows an easy control of the flow of refrigerant into each of the indoor units.

In accordance with one aspect of the present invention, there is provided a multiroom airconditioner comprising: a plurality of indoor units, each of them including an indoor heat exchanger and a valve for selectively opening and closing a flow of refrigerant from the indoor heat exchanger; an outdoor unit including a compressor, an outdoor heat exchanger divided into an identical number of sections as that of the indoor heat exchangers, an identical number of valves for selectively opening and closing the flow of the refrigerant from the compressor into the outdoor heat exchanger as that of the sections of the outdoor heat exchanger, and a blower fan for allowing a heat exchange between the refrigerant and air; an identical number of expansion valves as that of the sections for reducing a pressure of the refrigerant flowing from the outdoor unit into the indoor units; a temperature detecting unit for respectively detecting a temperature of the refrigerant at an inlet side and at an outlet side of each of the indoor exchangers; a device for equalizing the pressure of the refrigerant flowing from the indoor units to the compressor; and refrigerant conveying conduits for connecting each of the indoor units with each of the sections of the outdoor heat exchanger.

BRIEF DESCRIPTION OF THE DRAWINGS

The above and other objects and features of the present invention will become apparent from the following description of preferred embodiments, when taken in conjunction with the accompanying drawings, wherein.

DETAILED DESCRIPTION OF THE PREFERRED EMBODIMENTS

Figure 1:
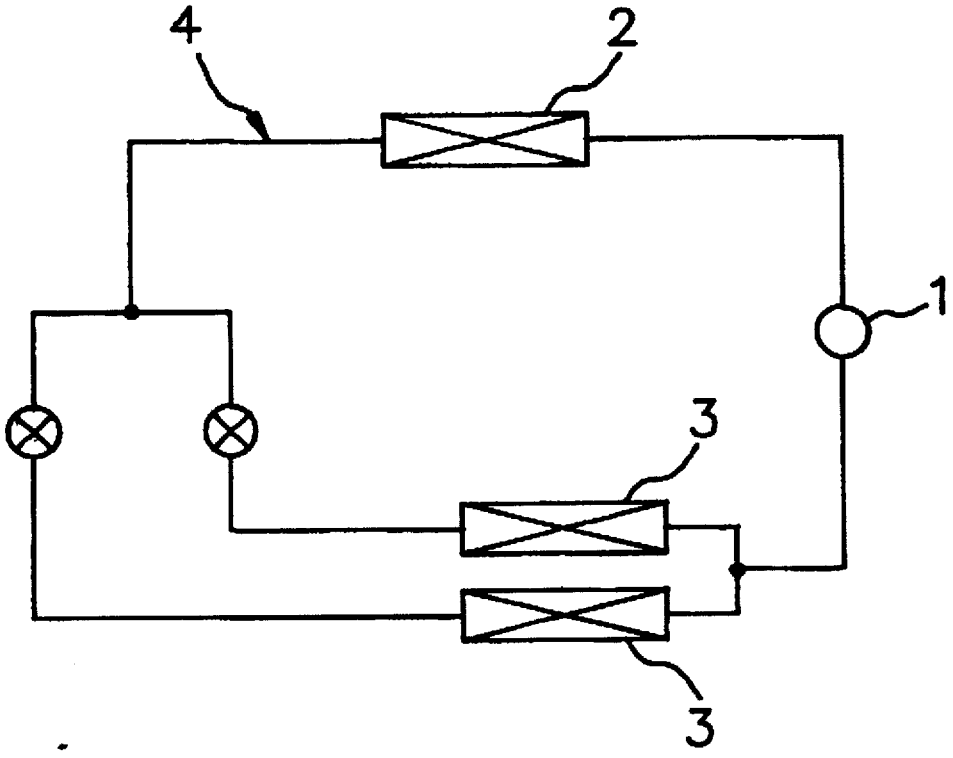
FIG. 1 (PRIOR ART)
FIG. 1 shows a refrigerant circuit diagram for a multiroom airconditioner in accordance with the conventional invention.
Figure 2:
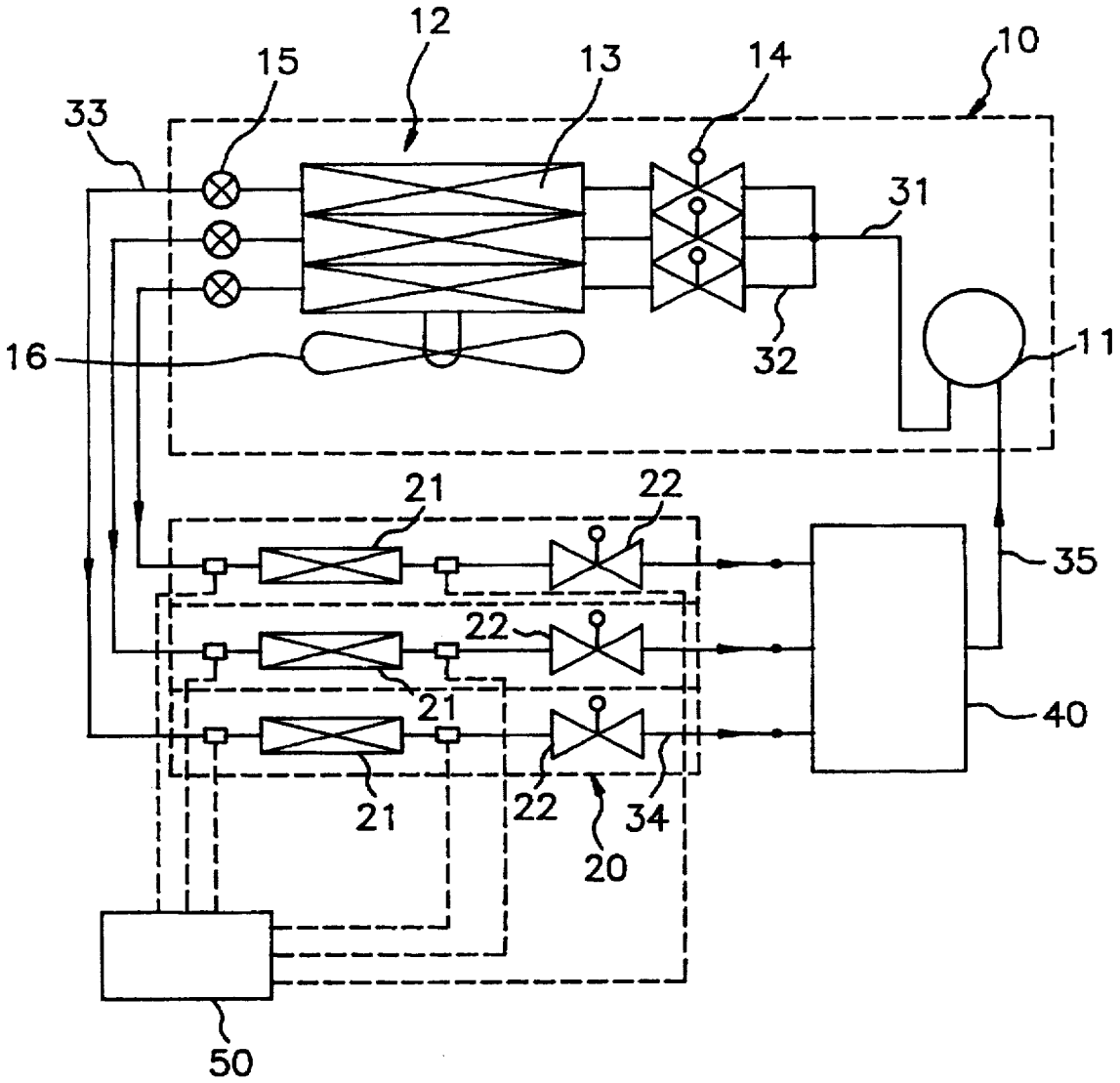
FIG. 2 depicts a refrigerant circuit diagram for a multiroom airconditioner in accordance with the present invention.

Referring to FIG. 2, there is shown a refrigeration cycle of a multiroom airconditioner, wherein the multiroom airconditioner includes a single outdoor unit 10, a plurality of indoor units 20, e.g., three indoor units, and refrigerant conveying conduits for connecting the outdoor unit 10 with each of the indoor units 20. The refrigerant conveying conduits include a common compressed refrigerant conduit 31, three compressed refrigerant conduit 32 branched from the common compressed refrigerant conduit 31, three liquefied refrigerant conduits 33, three gasified refrigerant conduits 34 and a common gasified refrigerant conduit 35.

The outdoor unit 10 includes a compressor 11 and a condenser 12 divided into three sections 13. The common compressed refrigerant conduit 31 through which the refrigerant compressed by the compressor 11 passes is branched into the three compressed refrigerant conduits 32 at an inlet side of the condenser 12 in such a way that the compressed refrigerant is allowed to pass through its corresponding condenser section 13. The outdoor unit 10 further includes three valves 14 for selectively opening and closing the flow of the refrigerant from the compressor 11 into each condenser section 13, the valves 14 set up at the inlet side of the condenser 12, three expansion valves 15 for reducing the pressure of the refrigerant flowing from the outdoor unit 10 into the indoor unit 20, the valves 15 set up at the outlet side of the condenser 12 and a blower fan 16 for allowing a heat exchange between the refrigerant and an air.

Figure 3:
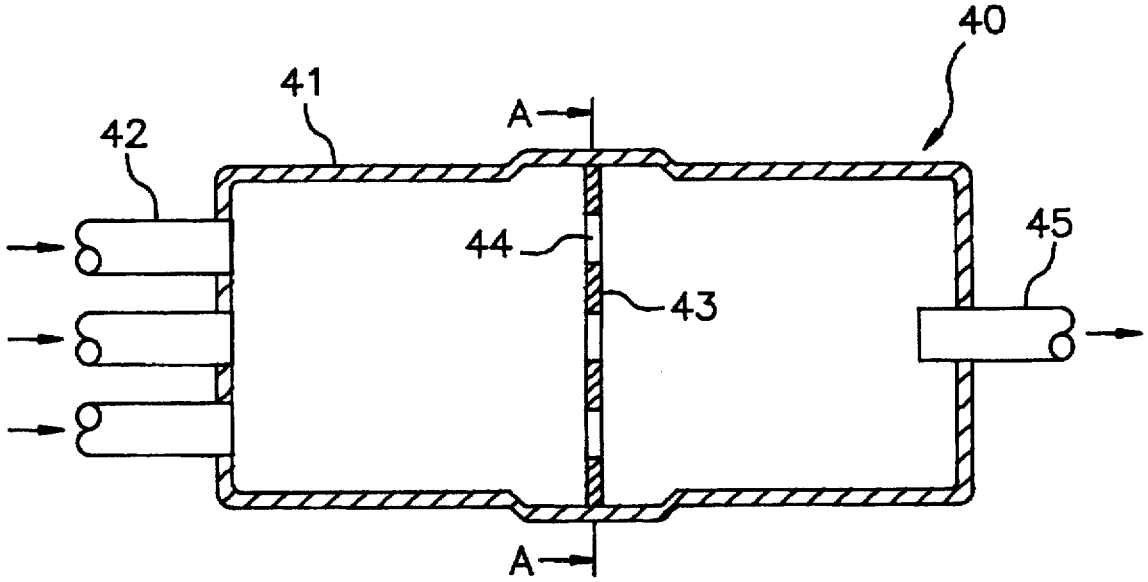
FIG. 3 illustrates a cross sectional view of a pressure-equalizing device in accordance with the present invention.
Figure 4:
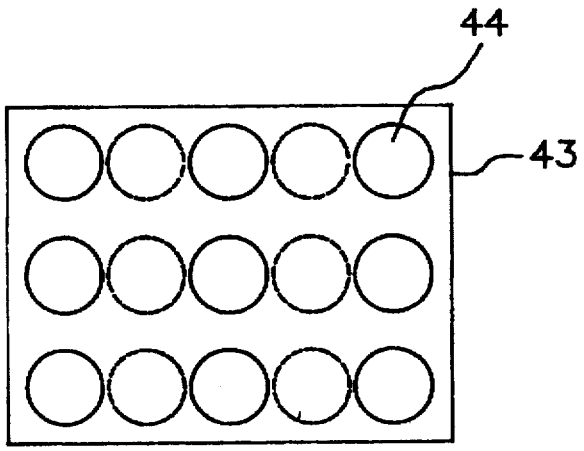
FIG. 4 presents a cross sectional view taken along a line A—A of the pressure-equalizing device in FIG. 3.

Each of the indoor units 20 are identically structured. Each of the indoor units 20 includes an evaporator 21 and a valve 22 for selectively opening and closing the flow of refrigerant from the indoor unit 20 into the outdoor unit 10, the valve 22 being set up at the outlet side of the evaporator 21. The evaporator 21 is connected with the compressor 11 in the outdoor unit 10 through the three gasified refrigerant conduits 34, a pressure-equalizing device 40 which will be described in detail later and the common gasified refrigerant conduit 35. As shown in FIG. 3, the pressure-equalizing device 40 for equalizing the pressure of the refrigerant flowing from each evaporator 21 into the compressor 11 includes a cylindrical housing 41 which is equipped with three pipes 42 at its inlet side, a perforated plate 43 at its central part and a pipe 45 at its outlet side. Each of the inlet side pipes 42 is connected with its corresponding gasified refrigerant conduit 34 and the outlet side pipe 45 is connected with the common gasified refrigerant conduit 35. The perforated plate 43 formed with a plurality of perforated holes 44 serves to partially obstruct the refrigerant flowing through the inlet side pipes 42 to the outlet side pipe 45 in such a way that its pressure is reduced and its velocity is increased partially, thereby equalizing the pressure of the refrigerant passing via the pressure-equalizing device 40 toward the compressor 11. It should be noted that the housing 41 has a cross sectional area which is ten times as large as that of the inlet pipe 42. The housing 41 may further be provided with second perforated plate in such a way that it is in a parallel relationship with respect to the forgoing perforated plate 43. In this case, the second perforated plate may be also formed with a plurality of second holes indicated by a dotted circle in such a way that the second holes are not overlapped with the holes 44, as indicated by a dotted circle in FIG. 4.

Another pressure-equalizing device may be also provided between the compressor 11 and the condenser 12. In this case, the inlet and the outlet sides of the pressure-equalizing device are, respectively, provided with one pipe for connecting with the common compressed refrigerant conduit 31 and the three pipes for connecting with the three compressed refrigerant conduits 32.

Furthermore, the present invention includes a temperature detecting unit 50 for respectively detecting the temperature of the refrigerant in the inlet side and in the outlet side of each of the evaporator 21.

In the cooling operation of the multiroom airconditioner in accordance with the present invention, the high temperature and high pressure gasified refrigerant discharged from the compressor 11 in the outdoor unit 10 passes through the common compressed refrigerant conduit 31 and the three compressed refrigerant conduits 32 to each of the condenser sections 13, which act to exchange the heat of the gasified refrigerant with that of the outdoor air, whereby the gasified refrigerant becomes the liquefied refrigerant. The liquefied refrigerant there formed then passes through each of the liquefied refrigerant conduits 33 and is directed to the its corresponding evaporator 21 in the indoor unit 20. At the evaporator 21, heat is exchanged between the refrigerant and the surrounding air in the room, whereby the refrigerant becomes a low-pressure gaseous refrigerant. Each of the expansion valve 15 is controlled by the controller (not shown) depending on the signals from the temperature detecting unit 50, whereby the flow of the refrigerant into the indoor unit 20 is controlled. The low-pressure gasified refrigerant passing through the three gasified refrigerant conduits 34 and the pressure-equalizing device 40 converges at the common gasified refrigerant conduit 35. The pressure-equalized gasified refrigerant passes through the common gasified refrigerant conduit 35 and returns to the compressor 11. The compressor 11 acts to compress the gasified refrigerant to form the high temperature and high pressure gaseous refrigerant, which is discharged from the compressor 11 again.

In such a multiroom airconditioner, since each of the sections of the condenser is connected to its corresponding evaporator in the indoor units, it is possible to independently control the flow of refrigerant into each individual indoor unit.

While the present invention has been described with respect to certain preferred embodiments only, other modifications and variations may be made without departing from the scope of the present invention as set forth in the following claims.

What is claimed is:

1. A multiroom airconditioner comprising:

a plurality of indoor units, each of them including an indoor heat exchanger and a valve for selectively opening and closing a flow of refrigerant from the indoor heat exchanger;

an outdoor unit including a compressor, an outdoor heat exchanger divided into an identical number of sections as that of the indoor heat exchangers, an identical number of valves for selectively opening and closing the flow of the refrigerant from the compressor into the outdoor heat exchanger as that of the sections of the outdoor heat exchanger, and a blower fan for allowing a heat exchange between the refrigerant and air;

an identical number of expansion valves as that of the sections of the outdoor heat exchanger for reducing a pressure of the refrigerant flowing from the outdoor unit into the indoor units;

a temperature detecting unit for respectively detecting a temperature of the refrigerant at an inlet side and at an outlet side of each of the indoor exchangers;

means for equalizing the pressure of the refrigerant flowing from the indoor units to the compressor; and refrigerant conveying conduits for connecting each of the indoor units with each of the sections of the outdoor heat exchanger.

2. The multiroom airconditioner of claim 1, wherein the refrigerant conveying conduits include a common compressed refrigerant conduit and an identical number of the compressed refrigerant conduits branched from the common compressed refrigerant conduit as that of the sections of the outdoor heat exchanger, for connecting the compressor with each section of the outdoor heat exchanger, an identical number of liquefied refrigerant conduits as that of the sections of the outdoor heat exchanger, for connecting each section of the outdoor heat exchanger with its corresponding indoor heat exchanger, and an identical number of gasified refrigerant conduits as that of the indoor heat exchangers and a common gasified refrigerant conduit, for connecting each indoor heat exchanger with compressor.

3. The multiroom airconditioner of claim 2, wherein the pressure-equalizing means includes a housing which is equipped with an identical number of pipes as that of the gasified refrigerant conduits at its inlet side, a single pipe at its outlet side and a first perforated plate for partially obstructing the refrigerant passing through the inlet side pipes toward the outlet side pipe at its central part, each of the inlet side pipes being connected with its corresponding gasified refrigerant conduit and the outlet side pipe being connected with the common gasified refrigerant conduit.

4. The multiroom airconditioner of claim 3, wherein the first perforated plate is formed with a plurality of holes.

5. The multiroom airconditioner of claim 3, wherein the housing is, further, equipped with a second perforated plate in such a way that it is in a parallel relationship with respect to the first perforated plate.

6. The multiroom airconditioner of claim 2, further comprising, another means for equalizing the pressure of the refrigerants flowing from the compressor to each section of the outdoor heat exchanger.

7. The multiroom airconditioner of claim 6, wherein the pressure-equalizing means includes a housing which is equipped with a single pipe at its inlet side, an identical number of pipes as that of the compressed refrigerant conduits at its outlet side and a first perforated plate for partially obstructing the refrigerant passing through the inlet side pipe toward the outlet side pipes at its central part, the inlet side pipe being connected with the common compressed refrigerant conduit and each of the outlet side pipes being connected with its corresponding compressed refrigerant conduits.

8. The multiroom airconditioner of claim 7, wherein the first perforated plate is formed with a plurality of holes.

9. The multiroom airconditioner of claim 7, wherein the housing is further equipped with a second perforated plate in such a way that it is in a parallel relationship with respect to the first perforated plate.

* * * * *